US010556718B2

(12) United States Patent
Scott

(10) Patent No.: US 10,556,718 B2
(45) Date of Patent: Feb. 11, 2020

(54) END CLOSURE WITH A RING PULL ACTUATED SECONDARY VENT

(71) Applicant: Ball Corporation, Broomfield, CO (US)

(72) Inventor: Anthony J. Scott, Westminster, CO (US)

(73) Assignee: Ball Corporation, Broomfield, CO (US)

( * ) Notice: Subject to any disclaimer, the term of this patent is extended or adjusted under 35 U.S.C. 154(b) by 150 days.

(21) Appl. No.: 15/581,932

(22) Filed: Apr. 28, 2017

(65) Prior Publication Data

US 2017/0232497 A1 Aug. 17, 2017

Related U.S. Application Data

(62) Division of application No. 14/198,174, filed on Mar. 5, 2014, now Pat. No. 9,694,935.
(Continued)

(51) Int. Cl.
*B21D 51/38* (2006.01)
*B65D 17/28* (2006.01)
*B65D 51/16* (2006.01)

(52) U.S. Cl.
CPC ..... *B65D 17/4012* (2018.01); *B21D 51/383* (2013.01); *B65D 17/404* (2018.01);
(Continued)

(58) Field of Classification Search
CPC ..... B21D 51/38; B21D 51/383; B21D 51/44; B65D 17/4012; B65D 17/404;
(Continued)

(56) References Cited

U.S. PATENT DOCUMENTS 1,847,794 A 3/1932 Takeda
2,160,429 A 5/1939 Bukolt
(Continued)

FOREIGN PATENT DOCUMENTS

AU 2016204140 8/2016
CA 2280461 2/2001
(Continued)

OTHER PUBLICATIONS

Official Action for European Patent Application No. 12846663.8, dated Nov. 16, 2017 3 pages.
(Continued)

*Primary Examiner* — Edward T Tolan
(74) *Attorney, Agent, or Firm* — Sheridan Ross PC

(57) ABSTRACT

The present invention relates to a container end closure that generally comprises a pour opening and a secondary vent opening which improves venting during emptying of contents from the container. In particular, the present invention relates to an end closure for a container having scores defining a secondary vent opening which may optionally be opened. The secondary vent opening has a significantly larger area then vents of prior art designs and thereby improves pour rate and smoothness of pour. After the pour opening is opened using a pull tab interconnected to the end closure, a consumer may selectively open the secondary vent opening by pulling back on the tab.

20 Claims, 10 Drawing Sheets

Related U.S. Application Data

(60) Provisional application No. 61/794,762, filed on Mar. 15, 2013.

(52) U.S. Cl.
CPC .. *B65D 51/1672* (2013.01); *B65D 2517/0013* (2013.01); *B65D 2517/0092* (2013.01)

(58) Field of Classification Search
CPC ..... B65D 51/1672; B65D 2517/0013; B65D 2517/0092
See application file for complete search history.

(56) References Cited

U.S. PATENT DOCUMENTS 2,272,111 A 2/1942 Dove
3,169,678 A 2/1965 Wilkinson
3,215,305 A 11/1965 Frankenberg
3,221,923 A 12/1965 Bozek
3,227,304 A 1/1966 Asbury
3,246,791 A 4/1966 Asbury
3,262,611 A 7/1966 Palmer
3,307,737 A 3/1967 Harvey et al.
3,326,406 A 6/1967 Brown
D208,591 S 9/1967 Bozek
3,362,569 A 1/1968 Geiger
3,370,169 A 2/1968 Bozek
3,441,169 A 4/1969 Dunn et al.
3,442,416 A 5/1969 Nicholson
3,446,389 A 5/1969 Brown
3,499,573 A 3/1970 Adams
3,618,815 A 11/1971 Heffner
3,731,836 A 5/1973 Silver
3,741,432 A 6/1973 Werth et al.
3,744,667 A 7/1973 Fraze et al.
3,762,597 A 10/1973 Kaminski et al.
3,765,208 A 10/1973 Cozert
3,779,417 A 12/1973 Klein
3,794,206 A 2/1974 De Line et al.
3,807,597 A 4/1974 Wells et al.
3,826,401 A 7/1974 Zundel
3,833,144 A 9/1974 Bollmann et al.
3,836,038 A 9/1974 Cudzik
3,856,184 A 12/1974 Luviano
3,877,604 A 4/1975 Brown
3,877,606 A 4/1975 Silver
3,881,630 A 5/1975 Lovell et al.
3,908,856 A 9/1975 Perry
D238,150 S 12/1975 Cudzik
D238,659 S 2/1976 Wallace
D239,255 S 3/1976 Brincks et al.
D239,256 S 3/1976 Brincks et al.
RE28,910 E 7/1976 Dalli et al.
3,970,212 A 7/1976 Brown
3,982,657 A 9/1976 Keller et al.
4,008,823 A 2/1977 Tarro
4,024,981 A 5/1977 Brown
4,030,631 A 6/1977 Brown
4,032,034 A 6/1977 Willis
4,039,100 A 8/1977 Wells
4,051,976 A 10/1977 Perry
4,054,228 A 10/1977 Balocca et al.
4,061,243 A 12/1977 Khoury
4,062,471 A 12/1977 Perry et al.
4,073,403 A 2/1978 Orange
4,084,721 A 4/1978 Perry
4,105,133 A 8/1978 La Barge et al.
4,128,186 A 12/1978 Gane
4,146,149 A 3/1979 Beveridge
4,148,410 A 4/1979 Brown
4,184,607 A 1/1980 Potts
4,196,823 A 4/1980 Madden et al.
D255,423 S 6/1980 Bathurst
D255,424 S 6/1980 Bathurst
D255,425 S 6/1980 Bathurst
4,205,760 A 6/1980 Hasegawa
RE30,349 E 7/1980 Silver
4,210,257 A 7/1980 Radtke
4,213,538 A 7/1980 Boardman
4,244,489 A 1/1981 Klein
4,244,490 A 1/1981 Klein
4,252,247 A 2/1981 Asbury
4,257,529 A 3/1981 Saunders
4,267,938 A 5/1981 Debenham et al.
D259,403 S 6/1981 Frazier
4,276,993 A 7/1981 Hasegawa
4,280,427 A 7/1981 Potts
4,289,251 A 9/1981 Maliszewski
4,305,523 A 12/1981 Dalli et al.
4,318,494 A 3/1982 Heyn
4,320,850 A 3/1982 Drolen, Jr.
4,361,251 A 11/1982 Langseder et al.
D267,633 S 1/1983 Christian
4,387,827 A 6/1983 Ruemer, Jr.
4,397,403 A 8/1983 Guimarin
4,402,421 A 9/1983 Ruemer, Jr.
4,416,389 A 11/1983 Wilkinson et al.
4,417,668 A 11/1983 Stolle
D271,857 S 12/1983 Callahan
4,438,865 A 3/1984 Scattaregia
4,448,325 A 5/1984 Edwards et al.
4,465,204 A 8/1984 Kaminski et al.
4,576,305 A 3/1986 Saunders
4,576,306 A 3/1986 Kelsey et al.
4,577,774 A 3/1986 Nguyen
4,701,090 A 10/1987 Smith
4,796,772 A 1/1989 Nguyen
4,832,223 A 5/1989 Kalenak et al.
4,901,880 A 2/1990 Tatham et al.
4,930,658 A 6/1990 McEldowney
4,994,009 A 2/1991 McEldowney
5,007,554 A 4/1991 Hannon et al.
5,011,037 A 4/1991 Moen et al.
5,064,087 A 11/1991 Koch
5,065,882 A 11/1991 Sugiyama
5,129,541 A 7/1992 Voigt et al.
5,131,555 A 7/1992 DeMars et al.
5,145,086 A 9/1992 Krause
5,190,149 A 3/1993 Krause
5,219,257 A 6/1993 Kock
5,224,618 A 7/1993 Garbiso
5,248,053 A 9/1993 Lundgren
5,285,919 A 2/1994 Recchia
5,307,947 A 5/1994 Moen et al.
D353,769 S 12/1994 Miller
5,375,729 A 12/1994 Schubert
5,397,014 A 3/1995 Aydt
5,405,039 A 4/1995 Komura
5,456,378 A 10/1995 DeMars
D365,274 S 12/1995 Cook
5,494,184 A 2/1996 Noguchi et al.
5,555,992 A 9/1996 Sedgeley
D382,481 S 8/1997 McEldowney
5,653,355 A 8/1997 Tominaga et al.
5,655,678 A 8/1997 Kobayashi
D385,192 S 10/1997 Hurst et al.
5,683,006 A 11/1997 Cook, III
D387,987 S 12/1997 Neiner
5,692,636 A 12/1997 Schubert
5,695,085 A 12/1997 Hadener
5,711,448 A 1/1998 Clarke, III
5,713,481 A 2/1998 Jordan
5,715,964 A 2/1998 Turner et al.
D396,635 S 8/1998 McEldowney
D397,296 S 8/1998 McEldowney et al.
5,819,973 A 10/1998 Traub, Sr. et al.
D402,555 S 12/1998 McEldowney et al.
D402,887 S 12/1998 Hurst
5,860,553 A 1/1999 Schubert
5,911,331 A 6/1999 Boller
5,938,390 A 8/1999 Jordan
D415,026 S 10/1999 Turner et al.
5,964,366 A 10/1999 Hurst et al.
5,975,327 A 11/1999 Funk

(56) References Cited

U.S. PATENT DOCUMENTS 5,979,697 A 11/1999 Kim
6,024,239 A 2/2000 Turner et al.
6,050,440 A 4/2000 McEldowney
D424,438 S 5/2000 Turner et al.
6,059,137 A 5/2000 Westwood et al.
6,062,414 A 5/2000 Mongarli et al.
6,079,583 A 6/2000 Chasteen
6,131,763 A 10/2000 Stanish et al.
6,145,866 A 11/2000 Peter
D434,983 S 12/2000 Hurst
6,161,717 A 12/2000 Forrest et al.
6,202,880 B1 3/2001 Strube et al.
D448,666 S 10/2001 Fields
6,330,954 B1 12/2001 Turner et al.
6,354,453 B1 3/2002 Chasteen
6,375,029 B2 4/2002 Anthony et al.
6,427,860 B1 * 8/2002 Nishida ..... B21D 51/383 220/269
6,499,329 B1 12/2002 Enoki et al.
D476,889 S 7/2003 Fields
6,715,629 B2 4/2004 Hartman et al.
6,761,281 B2 7/2004 Hartman
6,837,093 B2 1/2005 Yamasaki
7,000,797 B2 2/2006 Forrest et al.
7,096,759 B2 8/2006 Kirko
7,100,789 B2 9/2006 Nguyen et al.
D535,561 S 1/2007 Smith et al.
D559,680 S 1/2008 Jacober et al.
D579,771 S 11/2008 Cherian
7,478,550 B2 * 1/2009 Wynn ..... B21D 22/24 413/56
7,506,779 B2 3/2009 Jentzsch et al.
7,513,383 B2 4/2009 Hwang
7,516,869 B1 4/2009 Hajianpour
D600,116 S 9/2009 Cherian
D602,776 S 10/2009 Cherian
D612,724 S 3/2010 Cherian
7,748,557 B2 7/2010 Robinson
D623,963 S 9/2010 Fairchild et al.
7,891,519 B2 2/2011 Matsukawa et al.
7,918,359 B2 4/2011 Paris et al.
7,975,884 B2 7/2011 Mathabel et al.
D650,276 S 12/2011 Nesling et al.
D650,277 S 12/2011 Nesling et al.
D650,278 S 12/2011 Nesling et al.
D653,538 S 2/2012 Toms et al.
D653,944 S 2/2012 Seki et al.
8,136,689 B2 3/2012 Ulstein et al.
8,152,016 B2 4/2012 Berndt et al.
8,177,092 B2 5/2012 Mills
8,245,866 B2 8/2012 Gibson et al.
8,336,726 B2 12/2012 Ramsey et al.
8,397,935 B2 3/2013 Emanuele, III et al.
D691,039 S 10/2013 Jacober et al.
8,567,158 B2 10/2013 Chasteen et al.
8,573,432 B2 11/2013 Emanuele, III et al.
8,627,979 B2 1/2014 Thibaut et al.
8,646,643 B2 2/2014 Forrest et al.
D704,555 S 5/2014 Hernandez
D715,144 S 10/2014 Scott
D715,647 S 10/2014 Jacober et al.
8,893,913 B2 11/2014 McClung et al.
8,939,306 B2 1/2015 Rios
8,939,308 B2 1/2015 Ramsey et al.
8,950,619 B2 2/2015 Bork
8,978,915 B2 3/2015 Burleson, Jr.
D727,725 S 4/2015 Jacober et al.
8,998,015 B2 4/2015 Williams et al.
9,016,504 B2 4/2015 McClung et al.
9,033,174 B2 5/2015 Chasteen et al.
D731,887 S 6/2015 Keane et al.
9,156,585 B2 10/2015 Neiner
9,162,795 B2 10/2015 Thiemann et al.
9,181,007 B2 11/2015 Forrest et al.
9,186,924 B2 11/2015 Lewis
9,233,784 B2 1/2016 Jacober et al.
D749,415 S 2/2016 Scott
D750,488 S 3/2016 Jacober et al.
D762,114 S 7/2016 Jacober et al.
9,403,628 B2 8/2016 Keane et al.
9,446,879 B2 9/2016 Chasteen et al.
D770,891 S 11/2016 Porter
9,694,935 B2 7/2017 Scott
9,714,115 B2 7/2017 Chasteen et al.
2002/0005408 A1 1/2002 Yamasaki et al.
2002/0113069 A1 8/2002 Forrest et al.
2002/0139800 A1 10/2002 Hwang et al.
2003/0038134 A1 2/2003 Chasteen et al.
2003/0075544 A1 4/2003 Turner et al.
2003/0098306 A1 5/2003 Cho
2003/0192889 A1 10/2003 Chasteen et al.
2004/0056032 A1 3/2004 Vaughan
2004/0140309 A1 7/2004 Thibaut
2004/0144787 A1 7/2004 Heck
2004/0188440 A1 9/2004 Schlattl et al.
2004/0211786 A1 10/2004 Turner et al.
2005/0077316 A1 4/2005 Roberts
2005/0115976 A1 6/2005 Watson et al.
2005/0224497 A1 10/2005 Wook
2006/0049196 A1 3/2006 Price
2006/0196875 A1 9/2006 Cherian
2007/0039961 A1 2/2007 McEldowney et al.
2007/0045318 A1 3/2007 Gibson et al.
2007/0068943 A1 3/2007 Ramsey et al.
2007/0108208 A1 5/2007 Dickie
2007/0138178 A1 6/2007 Erickson
2007/0175896 A1 8/2007 Bursztein
2007/0215621 A1 9/2007 Shinguryo et al.
2007/0257035 A1 11/2007 Berndt et al.
2008/0011786 A1 1/2008 Mathabel et al.
2008/0110888 A1 5/2008 Turner et al.
2008/0302793 A1 12/2008 Tirosh et al.
2009/0001081 A1 1/2009 Schlattl et al.
2009/0039090 A1 2/2009 Forrest et al.
2009/0039091 A1 2/2009 Forrest et al.
2009/0057315 A1 3/2009 Stringfield et al.
2009/0173740 A1 7/2009 Ferguson
2009/0194536 A1 8/2009 Ulstein et al.
2009/0200305 A1 8/2009 Stude
2009/0206083 A1 8/2009 Heigl
2009/0266824 A1 10/2009 Turner et al.
2009/0269169 A1 10/2009 Turner et al.
2010/0000997 A1 1/2010 Southers
2010/0018976 A1 1/2010 Christian et al.
2010/0044383 A1 2/2010 Watson et al.
2010/0224511 A1 9/2010 Boatner
2010/0251731 A1 10/2010 Bergida
2010/0258562 A1 10/2010 Linden et al.
2010/0282706 A1 11/2010 Gilliam
2010/0294771 A1 11/2010 Holder et al.
2010/0326281 A1 12/2010 Nishibe et al.
2011/0056946 A1 3/2011 Emanuele, III et al.
2011/0108552 A1 5/2011 Rios
2011/0168714 A1 7/2011 Renz
2011/0226636 A1 9/2011 Petti
2011/0240645 A1 10/2011 Schley et al.
2011/0253719 A1 10/2011 Cherian
2011/0266281 A1 11/2011 Thiemann et al.
2011/0297679 A1 12/2011 Gogola et al.
2011/0303672 A1 12/2011 Fields et al.
2012/0012584 A1 1/2012 Chameroy et al.
2012/0048870 A1 3/2012 Ellerbe, III et al.
2012/0175371 A1 7/2012 Consonni
2012/0199586 A1 8/2012 Shamalta
2012/0199587 A1 8/2012 Norris
2012/0205378 A1 8/2012 Forrest
2012/0228296 A1 9/2012 Fields
2012/0260613 A1 10/2012 Holder et al.
2012/0312815 A1 12/2012 Ramsey et al.
2013/0037542 A1 2/2013 Crothers
2013/0037543 A1 2/2013 McClung et al.
2013/0075401 A1 3/2013 Forrest
2013/0126529 A1 5/2013 Nesling et al.
2013/0264343 A1 10/2013 Neiner

(56) References Cited

U.S. PATENT DOCUMENTS

| | | | |
|---|---|---|---|
| 2013/0264344 | A1 | 10/2013 | Neiner et al. |
| 2013/0270267 | A1 | 10/2013 | Ramsey et al. |
| 2013/0270269 | A1 | 10/2013 | Lewis |
| 2013/0292382 | A1 | 11/2013 | Bork |
| 2013/0299496 | A1 | 11/2013 | Forrest et al. |
| 2014/0054290 | A1 | 2/2014 | McClung et al. |
| 2014/0054332 | A1 | 2/2014 | McClung et al. |
| 2014/0069924 | A1 | 3/2014 | Malaviya |
| 2014/0103044 | A1 | 4/2014 | Ramsey et al. |
| 2014/0110408 | A1 | 4/2014 | Mitchell et al. |
| 2014/0158685 | A1 | 6/2014 | Thiemann et al. |
| 2014/0263320 | A1 | 9/2014 | Forrest et al. |
| 2014/0263329 | A1 | 9/2014 | Chasteen et al. |
| 2014/0263333 | A1 | 9/2014 | Keane et al. |
| 2014/0325943 | A1 | 11/2014 | Fesler |
| 2014/0367382 | A1 | 12/2014 | Neiner et al. |
| 2014/0374419 | A1 | 12/2014 | Neiner |
| 2015/0001220 | A1 | 1/2015 | Neiner |
| 2015/0053681 | A1 | 2/2015 | McClung et al. |
| 2015/0136776 | A1 | 5/2015 | Chasteen et al. |
| 2015/0158627 | A1 | 6/2015 | Ramsey et al. |
| 2015/0196948 | A1 | 7/2015 | McClung et al. |
| 2015/0239607 | A1 | 8/2015 | Fields et al. |
| 2015/0251803 | A1 | 9/2015 | Rayburn |
| 2015/0329238 | A1 | 11/2015 | Chasteen et al. |
| 2015/0367984 | A1 | 12/2015 | Forrest et al. |
| 2016/0023801 | A1 | 1/2016 | Keane |
| 2016/0023821 | A1 | 1/2016 | Jacober et al. |
| 2016/0039563 | A1 | 2/2016 | Dunwoody |
| 2016/0052667 | A1 | 2/2016 | Gatewood et al. |
| 2016/0215377 | A1 | 7/2016 | Stone et al. |
| 2016/0236825 | A1 | 8/2016 | Mijatovic |

FOREIGN PATENT DOCUMENTS

| | | |
|---|---|---|
| CA | 2657391 | 1/2008 |
| CN | 1125679 | 7/1996 |
| CN | 201343207 | 11/2009 |
| CN | 102625769 | 8/2012 |
| EP | 0542517 | 5/1993 |
| EP | 2038178 | 10/2010 |
| ES | 2458098 | 4/2014 |
| ES | 2525589 | 12/2014 |
| GB | 1436617 | 5/1976 |
| GB | 1532081 | 11/1978 |
| GB | 2280165 | 1/1995 |
| GB | 2291030 | 1/1996 |
| GB | 2320008 | 6/1998 |
| JP | H04-311452 | 11/1992 |
| JP | H05-178345 | 7/1993 |
| JP | H05-310248 | 11/1993 |
| JP | H06-219448 | 8/1994 |
| JP | 3009188 U | 3/1995 |
| JP | H07-132936 | 5/1995 |
| JP | H07-132937 | 5/1995 |
| JP | H08-151043 | 6/1996 |
| JP | H09-58681 | 3/1997 |
| JP | H09-301364 | 11/1997 |
| JP | H10-035662 | 2/1998 |
| JP | H10-245032 | 9/1998 |
| JP | 2001-18960 | 1/2001 |
| JP | 2003-285837 | 10/2003 |
| JP | 3578797 | 10/2004 |
| JP | 2004-359339 | 12/2004 |
| JP | 2005-088961 | 4/2005 |
| JP | 2006-069605 | 3/2006 |
| JP | 2007-22541 | 2/2007 |
| JP | 2007-529374 | 10/2007 |
| JP | 2009-543737 | 12/2009 |
| JP | 2010-215291 | 9/2010 |
| JP | 4879759 | 2/2012 |
| JP | 2013-531590 | 8/2013 |
| KR | 20050059718 | 6/2005 |
| NL | 1023297 | 11/2004 |
| WO | WO 94/13544 | 6/1994 |
| WO | WO 96/02432 | 2/1996 |
| WO | WO 97/22531 | 6/1997 |
| WO | WO 97/42088 | 11/1997 |
| WO | WO 00/56613 | 9/2000 |
| WO | WO 01/46025 | 6/2001 |
| WO | WO 2008/008892 | 1/2008 |
| WO | WO 2008/023983 | 2/2008 |
| WO | WO 2008/057207 | 5/2008 |
| WO | WO 2010/046516 | 4/2010 |
| WO | WO 2011/053776 | 5/2011 |
| WO | WO 2012/018549 | 2/2012 |
| WO | WO 2012/143322 | 10/2012 |
| WO | WO 2013/022592 | 2/2013 |
| WO | WO 2013/102594 | 7/2013 |
| WO | WO 2013/102595 | 7/2013 |
| WO | WO 2013/156624 | 10/2013 |
| WO | WO 2014/031926 | 2/2014 |
| WO | WO 2014/150180 | 9/2014 |
| WO | WO 2014/152235 | 9/2014 |
| WO | WO 2015/138413 | 9/2015 |

OTHER PUBLICATIONS

U.S. Appl. No. 29/519,461, filed Mar. 5, 2015, Jacober et al.
U.S. Appl. No. 29/545,384, filed Nov. 12, 2015, Jacober et al.
U.S. Appl. No. 15/657,374, filed Jul. 24, 2017, Chasteen et al.
"Aluminum Bottles are Here to Stay," The Packaging Insider, Dec. 28, 2011, 4 pages [retrieved from: http://thepackaginginsider.com/aluminum-bottles-coca-cola/].
"CDL End," Ball, 2016, 2 pages [retrieved from: http://www.ball.com/eu/solutions/markets-capabilities/capabilities/beverage-ends/cdl].
News Releases: "The Can, ReinVented: Louisville is Pilot Market for New Bud Light Vented Can" Anheuser-Busch InBev, Jun. 5, 2013, 3 pages.
Press Release: "Crown and Molson Coors Debut Cans with New Vented End in Canada," Crown Holdings, Inc., Jul. 11, 2013, 2 pages.
"How Ball Makes Beverage Ends," Ball, last modified Dec. 5, 2013, 1 page [retrieved from: http://www.ball.com/images/ball_com/product_options_files/How_Ball_Makes_Beverage_Ends.pdf].
"A Smoother Pour with Crown's Global Vent™," 2015, retrieved from www.crowncork.com/beverage-packaging/innovations-beverage-cans/global-vent, 2 pages.
Murray "Vented can ends give Coors a smoother pour," thedrinksreport, Jul. 12, 2013, 3 pages [retrieved from: http://www.thedrinksreport.com/news/2013/14996-vented-can-ends-give-coors-a-smoother-pour.html].
International Preliminary Report on Patentability for International (PCT) Patent Application No. PCT/US2014/020821, dated Sep. 24, 2015 8 pages.
Official Action with English Translation for China Patent Application No. 201480015945.9, dated Apr. 20, 2016 11 pages.
Notice of Allowance with English Translation for China Patent Application No. 201480015945.9, dated Sep. 20, 2016 5 pages.
Official Action for U.S. Appl. No. 14/198,174, dated Mar. 31, 2016 15 pages.
Official Action for U.S. Appl. No. 14/198,174, dated Sep. 29, 2016 17 pages.
Notice of Allowance for U.S. Appl. No. 14/198,174, dated Mar. 6, 2017 17 pages.

* cited by examiner

END CLOSURE WITH A RING PULL ACTUATED SECONDARY VENT

CROSS-REFERENCE TO RELATED APPLICATIONS

This application is a divisional application of U.S. patent application Ser. No. 14/198,174 filed Mar. 5, 2014, which claims priority under 35 U.S.C. § 119(e) to U.S. Provisional Patent Application Ser. No. 61/794,762 filed Mar. 15, 2013, each of which are incorporated herein by reference in their entireties.

FIELD OF THE INVENTION

The present invention relates to a container end closure that generally comprises a pour opening and a secondary vent opening which improves venting during emptying of contents from the container. In particular, the present invention relates to an end closure for a container having scores defining a secondary vent opening which may optionally be opened. The secondary vent opening has a significantly larger area compared to vents of known designs and thereby improves pour rate and smoothness of pour. Additionally, the secondary vent opening does not require a separate tool for opening.

BACKGROUND

Containers, and more specifically metallic beverage containers, are typically manufactured by interconnecting a beverage container end closure to the neck of a beverage container body. In some applications, an end closure may be interconnected on both a top side and a bottom side of a container body. More frequently, however, a beverage container end closure is interconnected on a top end of a beverage container body. Generally, the configuration of the container end closure may affect the level to which consumers, as well as bottlers, manufacturers, distributors, shippers, and retailers, are satisfied with the container. One factor believed to be of some importance to consumers is the pour characteristics of the container. In general, it is believed that consumers prefer to use containers capable of providing a relatively high pour rate. Additionally, it is believed consumers prefer containers that provide a smooth or substantially laminar pour, i.e., a pour which is not characterized by a series of surges or "glugging" which can cause splashing and/or can affect a beverage head, fizz or other carbonation or pressurization-related characteristics of the contents after pouring.

Conventional beverage container end closures generally have a single pour opening defined by a score line. The pour opening is generally designed for pouring the container contents, with little or no consideration given to inward air flow needed for the volume exchange that facilitates smooth and consistent pouring. Therefore, conventional beverage container end closures generally suffer from low, inconsistent, and/or uneven flow rates as the contents in the container are poured due to the fact that these end closures have only one opening area of a predetermined size.

There are several types of container end closures that have attempted to improve end closure pourability. One type is an end closure with a full aperture opening similar to a food can in which the entire end panel detaches from the can. Such fully detachable container end closures are not a good solution to the pourability problem because the fully detachable end frequently becomes litter when consumers do not properly dispose of the detached end.

Other container end closures attempt to improve pourability with a secondary vent aperture which is separate from the primary drinking opening. The separate vent aperture can generally be opened with a separate tool or by pressing a secondary scored area into the container. Examples are provided in U.S. Patent Application Publication Nos. 2011/0108552, 2011/0266281, 2012/0048870, 2012/0199586, 2012/0260613, 2013/0118133, and WIPO Patent Application Publication No. 2008/023983 which are incorporated herein by reference in their entireties. The separate vent apertures of these designs are generally smaller than the primary opening limiting the flow of air into the container through the vent, and therefore, the end closures described by these publications do not substantially improve pourability.

In addition, some separate vent apertures of the designs described by these publications require the use of a separate tool to open the vent aperture. Requiring a separate tool to open the vent aperture is inconvenient and requires the consumer to carry the tool to take advantage of any improved pour characteristics that may result from opening the separate vent aperture. Other examples of separate vent apertures of these designs are opened by aligning the tail or rear edge of the tab interconnected to the end closure with the vent aperture and then pressing the rear edge down onto the secondary score to sever the secondary score. The separate vent apertures designed to be opened in this manner can result in accidental opening of the vent aperture during shipment or storage if the tab or some other object presses against the secondary score.

Still another design which attempts to improve end closure pourability includes a secondary gate or tear panel which is pushed into the container after the primary pour opening is opened. An example of this type of secondary vent is provided in U.S. Pat. No. 5,555,992 which is incorporated herein by reference in its entirety. In this design, secondary scores connect the secondary gate to the primary pour opening. However, once the primary pour opening is opened, the end panel becomes weak and deforms easily. End closures of this design do not have a large enough range of motion to overcome the flexing of the end closure panel and are difficult to open. Thus, this is not an effective design to improve the pourability of an end closure.

Other end closure designs include a second opening connected to the pour opening. Some examples are provided in U.S. Pat. Nos. 3,762,597, 4,397,403, and 4,402,421 which are incorporated herein by reference in their entirety. End closures of these designs generally have a very narrow second opening which may not provide sufficient air flow into an interior of the container to improve flow rate of contents out of the container. In some cases, a lift ring used to open the pour opening is interconnected to the end closure over the pour opening and the lift ring must be pulled back to open the second opening before the product contained in the container can be consumed.

Yet other designs for end closures attempt to improve pourability with a vent created by extending the score line of the pour opening past a bending plane of the tab. This creates a small area of air flow back into the container. This is the least effective design for improving pourability because of the limitation in the size of the vent due to tab functionality. Examples of these designs are provided in U.S. Pat. Nos. 4,289,251, 6,079,583, 7,975,884, and U.S. Patent Application Publication No. 2012/0031056, which are incorporated herein by reference in their entireties.

These prior art designs fail to teach various novel features of the present invention. Furthermore, many previous attempts to improving pouring characteristics have involved major changes to the design of the container end closure, thus involving relatively high tooling or other equipment costs, design costs, testing costs and the like. Accordingly, there is an unmet need for a container end closure which improves pour rate, consistency, and smoothness of pour without requiring major changes to the design of the container or retooling during the manufacturing process.

SUMMARY OF THE INVENTION

The present invention solves the aforementioned need by providing a metallic end closure with controlled venting. The following invention generally describes a metal end closure with a pull tab, a pour opening, and a secondary vent opening that address these long-felt needs.

In one aspect of the present invention, a container end closure is provided with a pour opening portion and a secondary vent opening portion. The secondary vent opening portion may be selectively opened by a consumer to create improved flow characteristics due to a larger opened area and/or an area which allows for air intake into a container body through the secondary vent opening while enhancing the flow of contents of the container out of the pour opening.

Container end closures of the present invention are adapted for interconnection with a neck of a container body. More specifically, a metallic end closure of the present invention generally comprises a peripheral curl which is adapted for interconnection to a neck of a container body, a chuck wall extending downwardly from the peripheral curl, a countersink comprised of an outer panel wall and an inner panel wall, and a central panel extending inwardly from the inner panel wall and countersink. For the purposes of further supporting and enabling the present invention, U.S. Pat. No. 7,506,779 to Jentzsch et al., entitled "Method and Apparatus for Forming a Reinforcing Bead in a Container End Closure," and U.S. Pat. No. 7,100,789 to Nguyen et al., entitled "Metallic Beverage Can End With Improved Chuck Wall and Countersink," are incorporated by reference herein in their entireties.

It is another aspect of the present invention to provide an end closure with a secondary vent opening. The end closure generally comprises a peripheral curl adapted for interconnection to a neck of a container. A chuck wall is interconnected to the peripheral curl and extends downwardly therefrom. A countersink comprising an inner panel wall and an outer panel wall is interconnected to a lower portion of the chuck wall. A central panel is interconnected to the inner panel wall of the countersink. A pull tab generally comprising a forward edge and a rear edge is operably interconnected to the central panel by a rivet. In one embodiment, the pull tab further comprises an enlarged finger hole formed between the rivet and the rear edge of the pull tab. In another embodiment, the pull tab further comprises a grip area formed between the rivet and the rear edge of the pull tab, the grip area comprising at least one of ridges, grooves, bumps, protrusions, or other friction surfaces configured to facilitate grasping and pulling the pull tab. A first severable score line in the central panel is comprised of an origination point and a termination point. The first severable score line generally defines a first tear panel and a pour opening. A first hinge is positioned between the origination point and the termination point and is below the forward edge of the pull tab. A second severable score line is positioned in a right hemisphere of the central panel proximate to the first score and extends away from the first score at approximately a right angle. A third severable score line is positioned proximate to the first hinge and the first score line in a left hemisphere of the central panel. The second and third score lines generally extend away from the pour opening, the second score line in a substantially parallel orientation to the third score line. In one embodiment, the second score line is between approximately 0.375 inches and approximately 1.000 inches from the third score line at a point on a horizontal axis passing through the center of the central panel. In another embodiment, the second and third score lines have a minimum length of approximately 0.675 inches. In still another embodiment, the second and third score lines have a score residual thickness between approximately 0.0025 inches and approximately 0.0045 inches. In yet another embodiment, the second and third score lines flare outwardly to form termination features having a radius of curvature between approximately 0.060 inches and 0.500 inches. A second hinge is positioned between the second and third score lines, the second hinge generally comprising a form extending at least partially into the exterior surface of the end closure. The form can include any shape, channel, cut, groove, notch, recess, slot, depression, coining, and/or alteration to the surface of the central panel adapted to enable a second tear panel to bend or fold outwardly along the second hinge. In one embodiment, the form has a length of about 0.100 inches to about 1.00 inches. The secondary vent opening is defined by at least a portion of the first severable score line, the second severable score line, the third severable score line, and the second hinge, wherein the second and third score lines may be selectively severed to form the secondary vent opening by pulling the rear edge of the pull tab away from the first tear panel after the forward edge is used to sever the first tear panel.

It is another aspect of the present invention to provide transition zones between the first severable score line and the second and third severable score lines. The transition zones prevent inadvertent or unintended opening of the secondary vent opening by preventing propagation of the first score line into the second or third score lines when the tab is utilized to open the pour opening. In one embodiment, the transition zones may comprise a variation in score residual depth between the depth of the first score and the depth of the second and third score. In another embodiment, the transition zones may generally comprise a score path of the second and third scores that connect the second and third scores tangentially to the fracture path of the first score. In still another embodiment, the transition zones may generally comprise a score deviation such as a small, narrow coin located proximate to the first score and perpendicular to the score paths of the second and third scores. In yet another embodiment, the transition zones may generally comprise a small void region located approximately between the first score and the origination points of the second and third scores.

Various secondary vent opening geometries are contemplated. For example, in one embodiment the second and third score lines are substantially parallel to a vertical Y-axis that bisects the end closure. In some embodiments, the second and third score lines may have a curvilinear shape. Further, in still more embodiments, the second and third score lines are substantially symmetrical about the Y-axis. In yet another embodiment, the second and third score lines are not symmetrical about the Y-axis. The shape of the secondary vent opening may be selected based on the desired flow rate, the ease of fracturing the second and third score lines, and score termination features that prevent the second tear panel from being removed or separated from the end closure. The location of beginning and end points of the second and third score lines can vary as well. In some embodiments, the third score line may begin near the left transition zone located between the center of the end closure and the radially inner portion of the first hinge of the first tear panel. In other embodiments, the third score line may begin near the left transition zone which may be located between the central panel outer perimeter and the radially outer portion of the first hinge of the first tear panel. In yet another embodiment, the third score line may begin between the radially inner portion of the first hinge and the radially outer portion of the first hinge.

It is another aspect of the present invention to provide a tab which is capable of opening the first tear panel defined within the first score line through a first opening movement or lifting of the rear edge of the tab, and subsequently capable of being utilized to open the secondary vent opening through a second opening movement. In one embodiment, the tab is generally the same size and external profile of known Stolle style tabs wherein a non-voided area is provided in place of the finger hole on the rear edge of the tab. The non-voided area may have a series of bumps, ridges, or other grip features to help the consumer grasp and pull the tab back. In another embodiment, the tail or rear edge of the tab may have generally the same shape as known ring pull tabs but the tab may be provided with the nose end or forward edge of a stay-on-tab (SOT) style tab that is used to push in the first tear panel of the pour opening.

It is another aspect of the present invention to provide an end closure with a pour opening and a secondary vent opening wherein the consumer can selectively determine whether to utilize the secondary vent opening for venting, or drink from the container in a conventional manner from the pour opening without the increased flow resulting from opening the secondary vent opening. Stated differently, the pour opening of the present invention may operate even if the secondary vent opening is not opened. Thus, in one embodiment, the pour opening and the secondary vent opening may be opened in series through the application of one or more forces, wherein the force used to open the secondary vent opening is distinct from the force used to open the pour opening. In one embodiment, the secondary vent opening may not be opened without first opening the pour opening. Further, the secondary vent can be selectively opened only partially or fully depending on the preference of the consumer.

It is another aspect of the present invention to provide a method of manufacturing a metallic end closure with a secondary vent. This includes, but is not limited to, a method generally comprising: (1) cutting a metal blank from a continuous roll of a sheet metal material; (2) forming an end closure from the metal blank, the end closure comprising a chuck wall extending downwardly from a peripheral curl, a countersink interconnected to a lower end of the chuck wall, and a central panel interconnected to the countersink; (3) forming a first severable score line in the central panel, the first severable score line having an origination point and a termination point, wherein the first severable score line defines a first tear panel and a first hinge, and wherein the first tear panel defines a pour opening; (4) forming a second severable score line in the central panel, the second severable score line positioned proximate to the first score line on a first side of a vertical axis passing through a center of the central panel, the second severable score line extending away from the first score line at approximately a right angle; (5) forming a third severable score line in the central panel, the third severable score line positioned proximate to the first score line and the first hinge, the third severable score line positioned on a second side of the vertical axis, the third severable score line extending away from the first hinge, the third score line substantially symmetric to the second score line; (6) forming a second hinge in the central panel, the second hinge positioned between the second score line and the third score line; and (7) interconnecting a pull tab having a forward edge and a rear edge to the central panel, wherein the pull tab is substantially centered on the central panel, wherein the first tear panel is positioned below the forward edge of the pull tab, and wherein the second hinge and the second and third score lines define a second tear panel and the secondary vent when the pull tab is pulled away from the pour opening. One example of the general geometry of a metallic end closure is described in U.S. Patent Application Publication No. 2013/0118133, which is incorporated herein by reference in its entirety.

Optionally, the method may further comprise (8) forming a second score line termination feature and a third score line termination feature, wherein the second score line termination feature and the third score line termination feature are adapted to prevent the second tear panel from detaching from the central panel; and (9) forming transition portions between the first score line and the second and third score lines, wherein the transition portions are adapted to prevent a fracture propagation of the first score line into the second and third score lines. The second hinge comprises a form extending at least partially into a public side of the end closure. In one embodiment, the form of the second hinge is positioned approximately 0.500 inches to approximately 0.850 inches from the center of the end closure. In another embodiment, the form has a depth between approximately 0.001 inches and 0.030 inches and a length of between approximately 0.100 inches and approximately 1.00 inches. In yet another embodiment, the second score line and the third score line have a score residual thickness of between approximately 0.0025 inches and approximately 0.0045 inches. In still another embodiment, the second tear panel has an area no less than an area of the first tear panel. The transition portions comprise at least one of a score deviation in the second and third score lines, a void area between the first score line and the second and third score lines, a variation in residual depth of the first score line and the second and third score lines, and a score path of the second and third score lines oriented tangentially to a direction of fracture of the first score line.

Another aspect of the present invention is to provide a method of opening a beverage container with a pour opening and a secondary vent opening. The method includes, but is not limited to (1) providing the container body with a lower end with a support surface and a neck on an upper end; (2) providing a metallic end closure with a peripheral curl interconnected to the neck of the container, a chuck wall, a countersink, and a central panel; (3) providing the pour opening in the central panel with a first area defined by a first score and a first hinge; (4) providing the secondary vent opening in the central panel defined by a portion of the first score, a second score, a third score, and a second hinge, the secondary vent opening generally comprising a second area equal to or greater than the first area; (5) providing a pull tab with a forward edge and a rear edge, the pull tab operably interconnected to the central panel, the interconnection substantially centered on the central panel, the forward edge positioned over at least a portion of the first tear panel; (6) pulling the rear edge to drive the forward edge into the first tear panel to shear the first score and create the pour opening; and (7) optionally pulling the rear edge away from the pour opening to sever the second score and the third score to create the secondary vent opening, wherein air is allowed to ingress into the secondary vent opening while product is being dispensed from the pour opening.

In yet another aspect of the present invention, a container end closure with a pour opening and a secondary vent opening is provided which improves the consumer's ability to smell the product contained in a container during dispensing. The secondary vent opening may increase air flow out of the container with the end closure of the present invention. When the consumer drinks from the container, the secondary vent is located in close proximity to the consumer's nose, thus expelled air caused by the dispensing of the liquid travels straight to the consumer's nose. This improves the consumer's perception of the taste of the product because research shows that a product's taste is greatly enhanced by the scent of the product.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1:
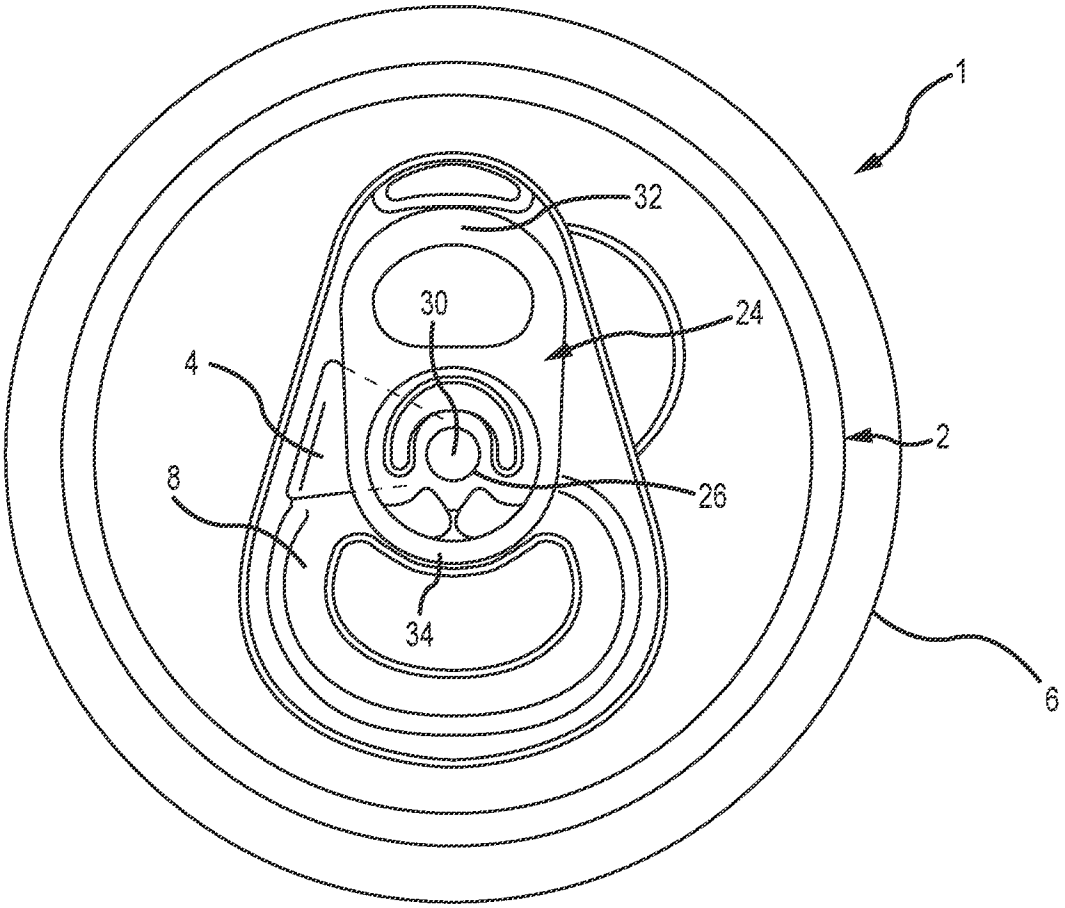
FIG. 1 (PRIOR ART)
FIG. 1 is a top plan view of a prior art end closure interconnected to a neck of a container, wherein the end closure has a secondary vent panel connected to a tear panel.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 1 | Container |
| 2 | End closure |
| 4 | Secondary vent panel |

-continued

| Number | Component |
|---|---|
| 6 | Container body |
| 7 | Neck |
| 8 | Pour tear panel |
| 10 | End closure |
| 12 | Secondary vent panel |
| 14 | Container end closure |
| 17 | Central panel |
| 18 | First score |
| 20 | Debossed area |
| 21 | Pour opening |
| 22 | First tear panel |
| 23 | Debossed area depth |
| 24 | Tab |
| 26 | Rivet |
| 30 | Pivot point |
| 32 | Rear edge |
| 34 | Forward edge |
| 35 | Open area |
| 36 | First hinge |
| 40 | Countersink |
| 48 | Peripheral seam |
| 50 | Panel outer perimeter |
| 52 | X-axis |
| 54 | Y-axis |
| 56 | Upper right quadrant |
| 57 | Lower right quadrant |
| 58 | Lower left quadrant |
| 59 | Upper left quadrant |
| 60 | Third score |
| 62 | Score residual |
| 64 | Left transition zone |
| 66 | Score separation distance |
| 68 | Second score |
| 72 | Right transition zone |
| 76 | Secondary vent opening |
| 78 | Second tear panel |
| 80 | Score termination feature |
| 84 | Third score end |
| 88 | Second score end |
| 90 | Second hinge |
| 92 | Hinge length |
| 94 | Form |
| 96 | Public side |
| 98 | Form width |
| 100 | Form depth |
| 102 | Distance to second hinge |
| 104 | Distance to exterior of container body |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict metal end closures with embodiments of a secondary vent opening, the present invention is not limited to these embodiments.

Referring now to FIG. 1, a top plan view of a prior art end closure 2 interconnected to a body 6 of a container 1 is illustrated. The end closure 2 has a secondary vent panel 4 which is connected to a pour tear panel 8. The pour tear panel 8 and secondary vent panel 4 are illustrated in a closed configuration. A tab 24 is used to open the container by severing scores that form the pour tear panel 8 and the secondary vent panel 4. The tab 24 is coupled to the end closure 2 by a rivet 26 whose center defines a pivot point 30. Generally, lifting the rear edge 32 of the tab 24 up and away from the end closure 2 results in the forward edge 34, or nose, of the tab 24 pressing downward on a part of the pour tear panel 8 with sufficient force to cause a rupture to form along the severable score that forms the pour tear panel 8. The rupture of the severable score permits the pour tear panel 8 to bend inward into the container 1 to create a pour opening. The tab 24 is then bent back down generally parallel to the exterior surface of the end closure 2. Next, the tab 24 is rotated clockwise around the pivot point 30 to align the forward edge 34 of the tab 24 over the secondary vent panel 4. The rear edge 32 of the tab 24 is lifted again to drive the forward edge 34 into the secondary vent panel 4 to bend the secondary vent panel 4 inward to enlarge the pour opening.

Figure 2:
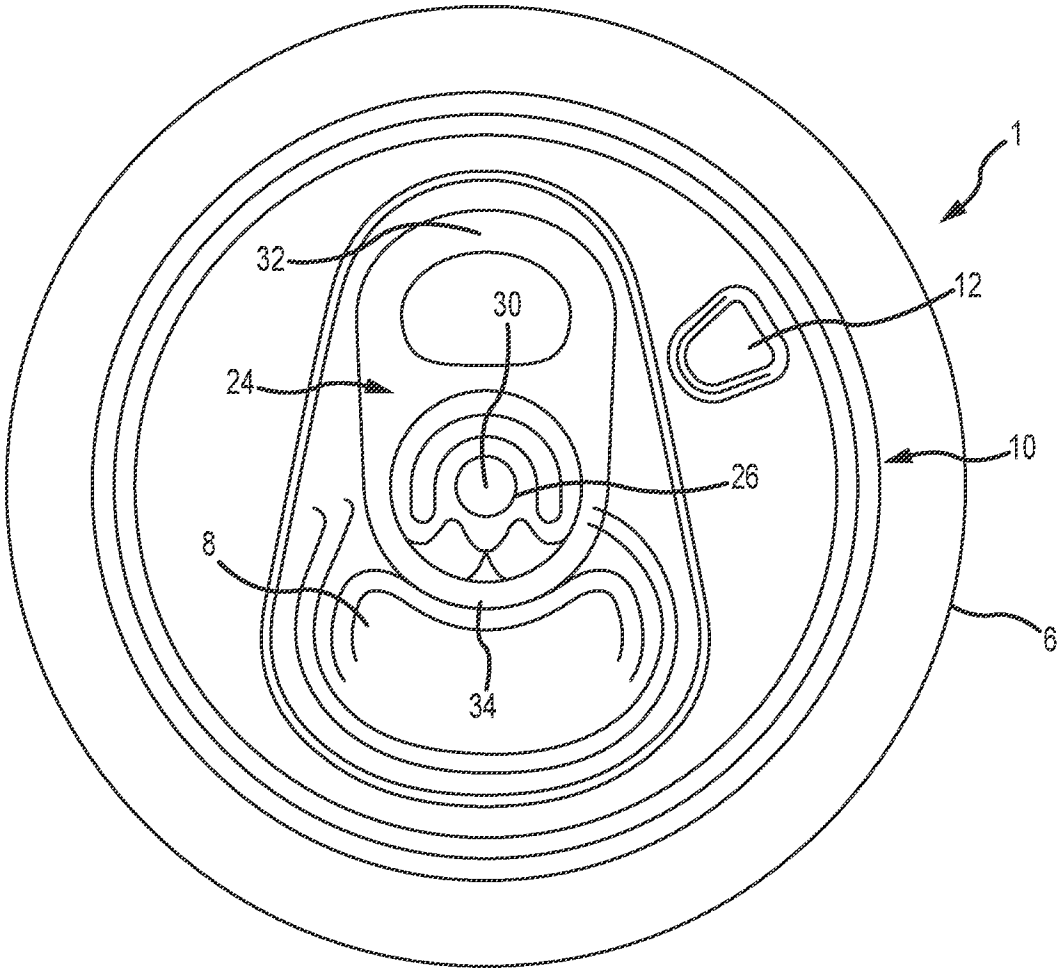
FIG. 2 (PRIOR ART)
FIG. 2 is a top plan view of another prior art end closure interconnected to a neck of a container, wherein a secondary vent panel is formed near the perimeter of a central panel of the end closure and the secondary vent panel is not connected to a primary pour tear panel.

A top plan view of another prior art end closure 10 interconnected to a body 6 of a container 1 is illustrated in FIG. 2. The end closure 10 has a pour tear panel 8 and a secondary vent panel 12 which are in an initial closed configuration. The secondary vent panel 12 is formed on the end closure 10 at a position separate from the pour tear panel 8. The pour tear panel 8 is opened with a tab 24 as described in conjunction with FIG. 1, above. After the pour tear panel 8 is opened, the secondary vent panel 12 may be opened by rotating the tab 24 clockwise to position a rear edge 32 of the tab 24 over the secondary vent panel 12. The rear edge 32 is then pressed downward and against the secondary vent panel 12 to rupture the severable score and bend the secondary vent panel 12 into the container 1 to create a secondary vent opening. Optionally, the secondary vent panel 12 may be opened by pressing a tool against the secondary vent panel 12 to bend it into the container 1.

Figure 3:
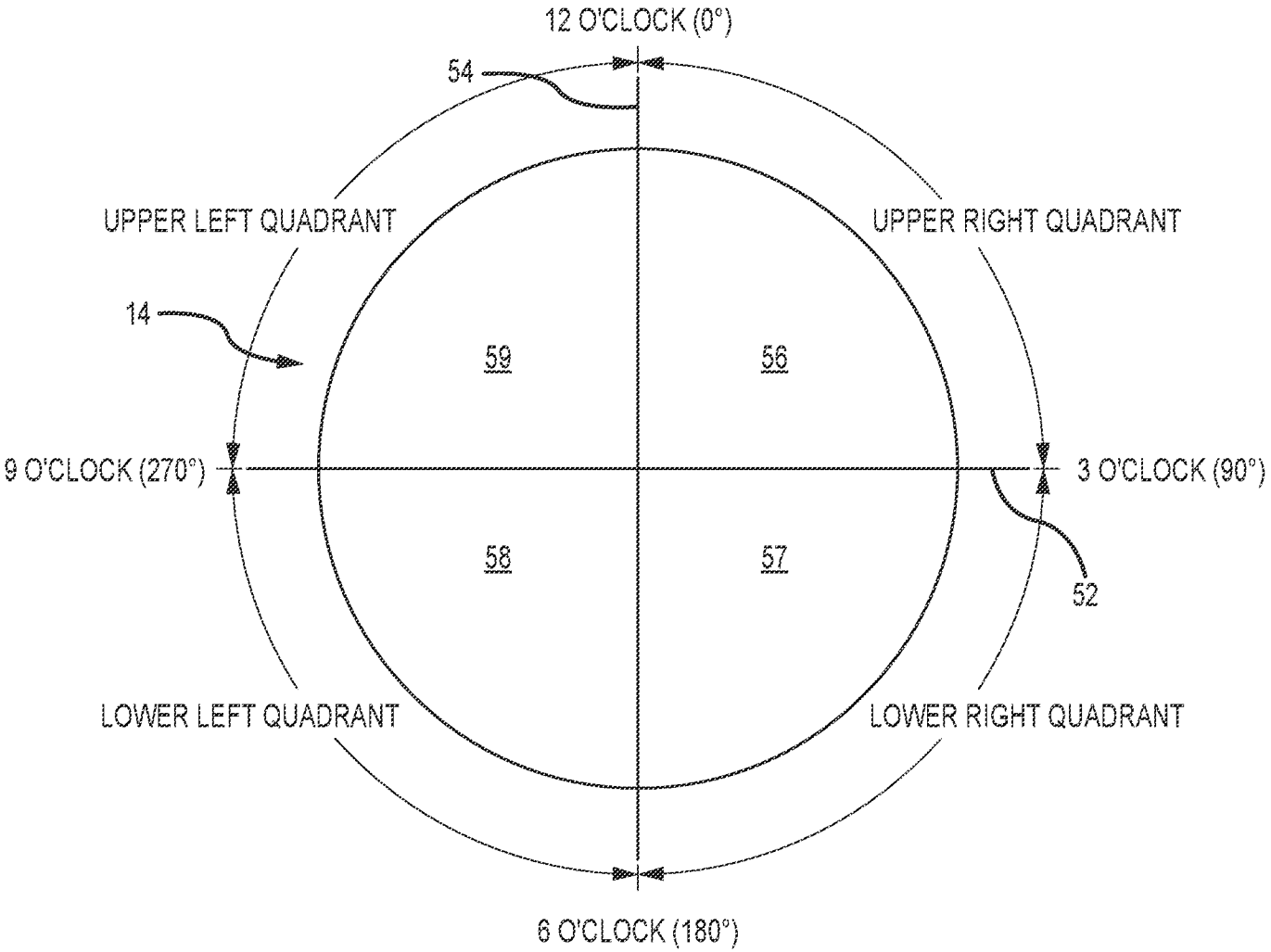
FIG. 3 is a top plan view of an end closure segmented into four quadrant zones.

Referring now to FIG. 3, a top plan view is provided of a container end closure 14 segmented into four quadrant zones. The quadrant zones are used for description purposes and may be referenced throughout the disclosure. As shown in FIG. 3, the end closure 14 has an X-axis 52 and a Y-axis 54 defining an upper right quadrant 56, a lower right quadrant 57, a lower left quadrant 58, and an upper left quadrant 59.

Figure 4:
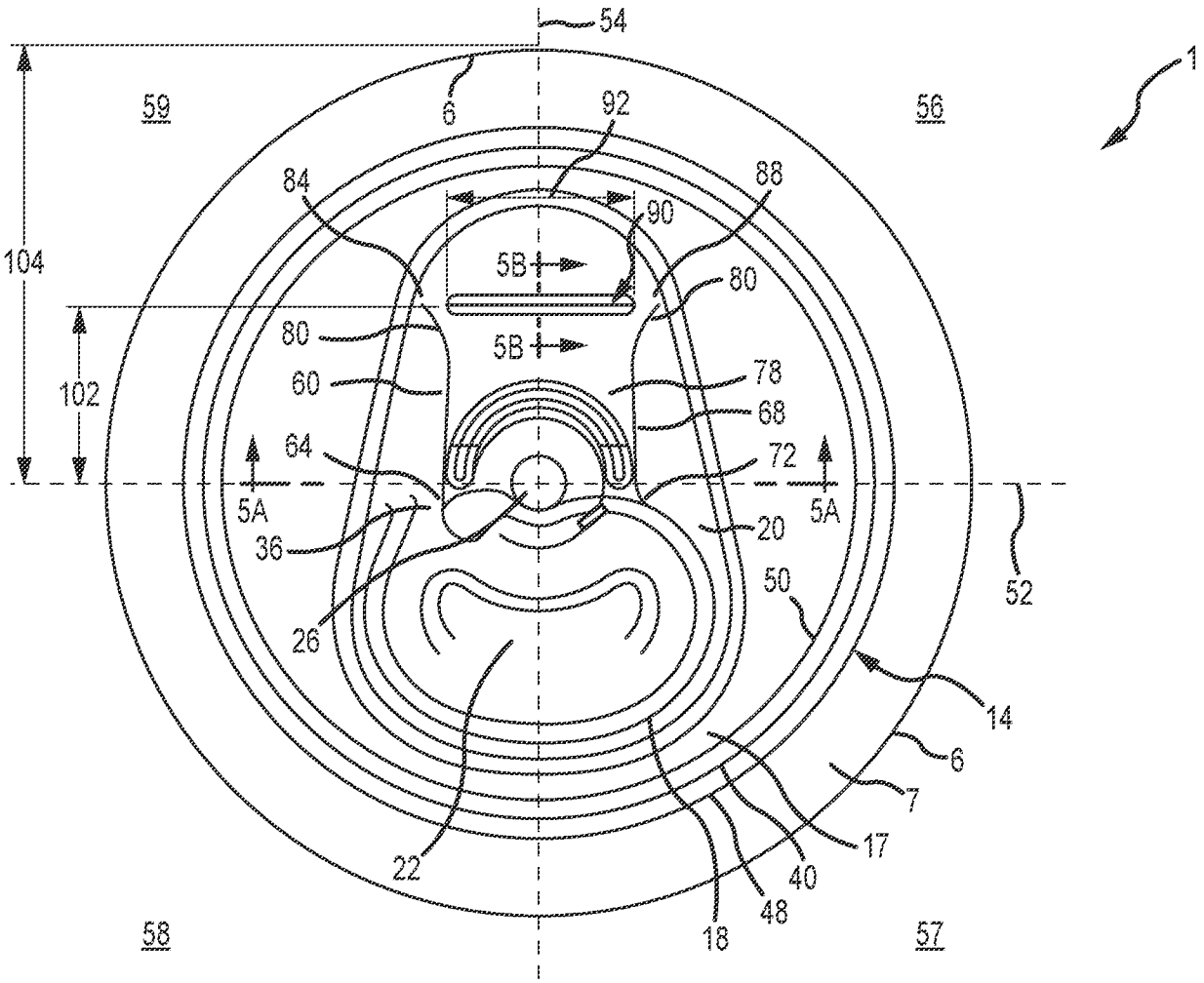
FIG. 4 is a top plan view of a container end closure interconnected to a neck of a container according to one embodiment of the present invention, wherein a first tear panel and a second tear panel are in a closed configuration.

Referring now to FIG. 4, a top plan view of a container 1 with a metal end closure 14 according to one embodiment of the present invention is provided. The end closure 14 is interconnected to a neck 7 of a container body 6. The end closure 14 has a central panel 17 with an outer perimeter or circumference 50 and a countersink 40. The countersink generally comprises an inner panel wall and an outer panel wall, which is in turn interconnected to a chuck wall and a peripheral seam 48. Before double seaming to the container body 6, the end closure 14 has an outer edge formed into a peripheral curl. Upon interconnection to the container body 6, the peripheral curl is formed into the peripheral seam 48.

The central panel 17 has a recessed or debossed area 20 with a first tear panel 22 associated with a first score 18 and a first hinge 36. The first tear panel 22 is generally located in lower quadrants 57, 58 and is illustrated in FIG. 4 in a closed configuration. Although the first tear panel 22 as shown is generally elliptically shaped, it should be understood that the first tear panel 22 may have any shape selected for pour characteristics, including a circular or oval shape, or any combination thereof. As will be understood by one of ordinary skill in the art, the first hinge 36 may be positioned on either side of the Y-axis 54. A tab (not illustrated in FIG. 4) is interconnected to the end closure 14 by a rivet 26. The rivet 26 is generally centered on the end closure 14 at the intersection of the X-axis 52 and the Y-axis 54, although it may be off-set along the Y-axis 54. The tab is positioned to bend the first tear panel 22 inward to open the container 1 as described above with respect to FIG. 1.

A second score line 68 intersects the first score line 18 at approximately a right angle near a right transition zone 72 on the right side of the Y-axis 54. A third score line 60 intersects the first score line 18 near a left transition zone 64 near the hinge 36 on the left side of the Y-axis 54. The second score 68 and the third score 60 extend away from the first score line 18 across the end closure 14 into the upper quadrants 56, 59 to end 88 and end 84. The second score 68 and the third score 60 define a second tear panel 78. In one embodiment, the scores 60, 68 have a minimum length of approximately 0.675 inches. In the embodiment illustrated in FIG. 4, score lines 60, 68 are substantially parallel to the Y-axis 54. One of ordinary skill in the art will appreciate, however, that the location, shapes, beginning points, and end points of score lines 60, 68 may be altered and/or repositioned in a variety of ways. It will also be recognized by one skilled in the art that the score design of the first score line 18 and scores 60, 68 require careful balancing of dimensions and design parameters in order to ensure that the first tear panel 22 and the second tear panel 78 and other portions of the central panel remain closed at appropriate times (e.g., during packaging and shipping operations) and yet will open under a reasonable amount of consumer-applied force.

The transition zones 64, 72 of the present invention generally comprise areas that inhibit fracture propagation of the score 18 into the second score 68 and the third score 60 and thus may prevent the unintentional or inadvertent opening of the second tear panel 78. In one embodiment, transition zones 64, 72 of the present invention may terminate propagation of the first score 18 fracture due to a variation in residual depth of score 18 and residual depth of scores 60, 68. For example, the score residual thickness 62 of scores 60, 68 may be about 0.0005 inches less than the score residual thickness of score 18. In another embodiment, the transition zones 64, 72 may comprise a score path that connects the scores 60, 68 tangentially to the first score 18 from a direction of the fracture path of the first score 18. In another embodiment, the transition zones 64, 72 may be defined by a predetermined void distance between the first score 18 and scores 60, 68. For example, a small void consisting of an unscored area of the end closure 14 may be left between each of scores 60, 68 and the first score 18 to form the transition zones 64, 72. In another embodiment, the transition zones 64, 72 may comprise a score deviation similar to an anti-missile feature. The score deviation may be a small, narrow coin located proximate to the first score 18 and perpendicular to the path of each of the scores 60, 68. The score deviation may also be an interference in the path of score 18 or scores 60, 68 such as a check slot. In a further embodiment, plastisol or other adhesives may also be used to minimize the chance of inadvertent fracture of scores 60, 68.

Score termination features 80 of the present invention are provided to generally define or limit the propagation of scores 60, 68 and to create a desired shape for the second tear panel 78. In one embodiment shown in FIG. 4, the score termination features 80 comprise curved segments near score ends 84, 88. The curved segments represent a departure from the general path of the scores 60, 68 and space score ends 84, 88 apart. The curved segments flare radially outwardly to direct the path of the scores 60, 68 toward the panel outer perimeter 50 and prevent the second tear panel 78 and the tab from detaching from the end closure 14. In one embodiment, the score termination features 80 of the present invention may generally comprise curved segments with a radius of curvature between approximately 0.060 inches and approximately 0.500 inches. In a preferred embodiment, the radius of curvature of the curved segment may be between approximately 0.217 inches and approximately 0.437 inches. In a more preferred embodiment, the radius of curvature of the curved segment may be approximately 0.375 inches.

A second hinge 90 may optionally be formed between scores 60, 68. The second hinge 90 may be generally perpendicular to the Y-axis 54 and have a length 92 extending at least partially into upper quadrants 56, 59. In one embodiment, the length 92 of the second hinge 90 may be between approximately 0.100 inches and approximately 1.0 inches. In a preferred embodiment, the length 92 of the second hinge 90 may be between approximately 0.300 inches and approximately 0.750 inches, and in a more preferred embodiment, the length 92 of the second hinge 90 may be approximately 0.500 inches. In one embodiment, the second hinge 90 may be formed a distance 102 from a center of rivet 26 equal to approximately one-half of the distance 104 from a point tangent to an exterior surface of the container body 6 to the center of the rivet 26. In a preferred embodiment, the distance 102 between the second hinge 90 and the center of the rivet 26 may be between approximately 0.500 inches and approximately 0.850 inches. In a more preferred embodiment, the distance 102 between the second hinge 90 and the center of rivet 26 may be approximately 0.675 inches. One of skill in the art will recognize that the second hinge 90 could be formed closer to the rivet 26 or further from the rivet 26. Although various dimensions are described to illustrate exemplary embodiments and locations of the second hinge 90, it is expressly contemplated that dimensions, shapes, and locations of the second hinge 90 and the form 94 may be varied and still comport with the scope and spirit of the present invention.

In general, the second hinge 90 may be formed to make the second tear panel 78 easier to open and to provide an area to fold the second tear panel 78 back over the container end closure 14. No rupture occurs along the second hinge 90 during a normal opening sequence.

Figure 5A:
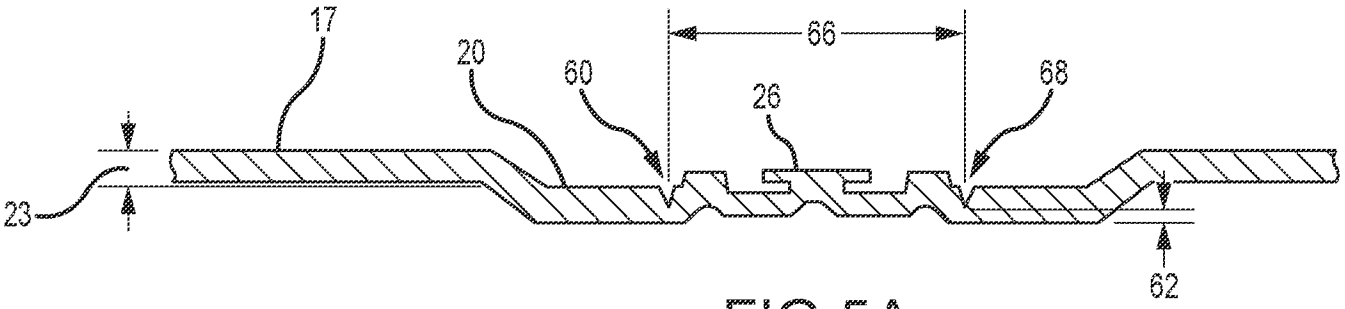
FIG. 5A is a partially fragmented cross-sectional elevation view of the container end closure of FIG. 4 taken along line 5A.

Referring now to FIG. 5A, a partially fragmented cross-sectional elevation view taken along line 5A of FIG. 4 is illustrated with the tab removed for clarity. The debossed area 20 generally has a depth 23 of between approximately 0.005 inches and approximately 0.025 inches. The second score 68 and third score 60 generally have a score residual thickness 62 of between approximately 0.0025 inches and approximately 0.0045 inches. The centerlines of scores 60, 68 are separated by a distance 66 of between approximately 0.375 inches and approximately 1.000 inches. Although various dimensions are provided to illustrate one exemplary embodiment of the present invention, the present invention is not limited to these dimensions and it is expressly contemplated that the depth 23 of the debossed area 20, the score residual thickness 62 of the scores 60, 68, and the distance 66 between the scores 60, 68 may be varied and still conform with the scope and spirit of the present invention.

Figure 5B:
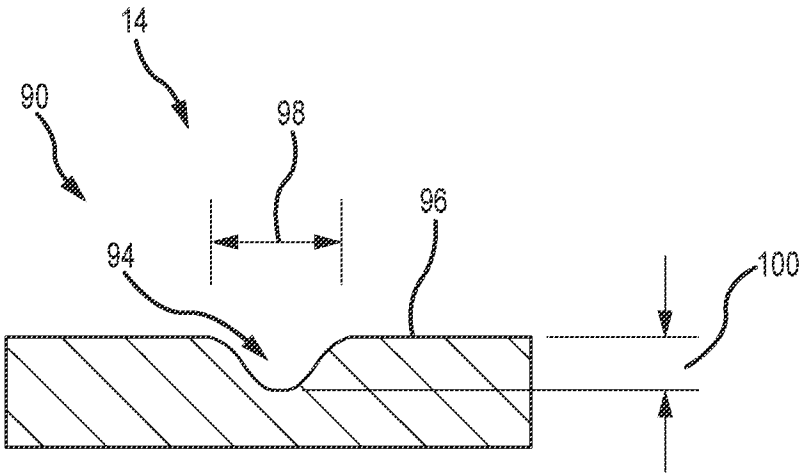
FIG. 5B is a partially fragmented cross-sectional elevation view of the container end closure of FIG. 4 taken along line 5B.

Referring now to FIG. 5B, a partially fragmented cross-sectional elevation view of the container end closure 14 taken along line 5B of FIG. 4 is illustrated. As illustrated in FIG. 5B, in one embodiment the second hinge 90 generally comprises a form 94 extending at least partially into the exterior or public side 96 of the end closure 14. The form 94 can include any shape, channel, cut, score, anti-fracture score, groove, notch, recess, slot, depression, coining, and/or alteration to the public side 96 of the central panel 17 adapted to enable the second tear panel 78 to bend or fold outwardly along the second hinge 90. The form 94 has a width 98 and a depth 100. In one embodiment, the width 98 of the form 94 may be between approximately 0.025 inches and approximately 0.250 inches. In a preferred embodiment, the width 98 may be between approximately 0.062 inches and approximately 0.175 inches. In a more preferred embodiment, the width 98 of the form 94 may be approximately 0.100 inches.

The depth 100 of the form 94 may be between approximately 0.001 inches and approximately 0.030 inches in one embodiment. In a preferred embodiment, the depth 100 may be between approximately 0.005 inches and approximately 0.02 inches. In a more preferred embodiment, a form 94 of the present invention generally comprises a depth 100 of approximately 0.010 inches. Optionally, the second hinge 90 may be formed by the score termination features 80 of the score ends 84, 88. For example, the score termination features 80 of the scores 60, 68 may be configured to form the second hinge 90 without the use of the form 94.

Figure 5C:
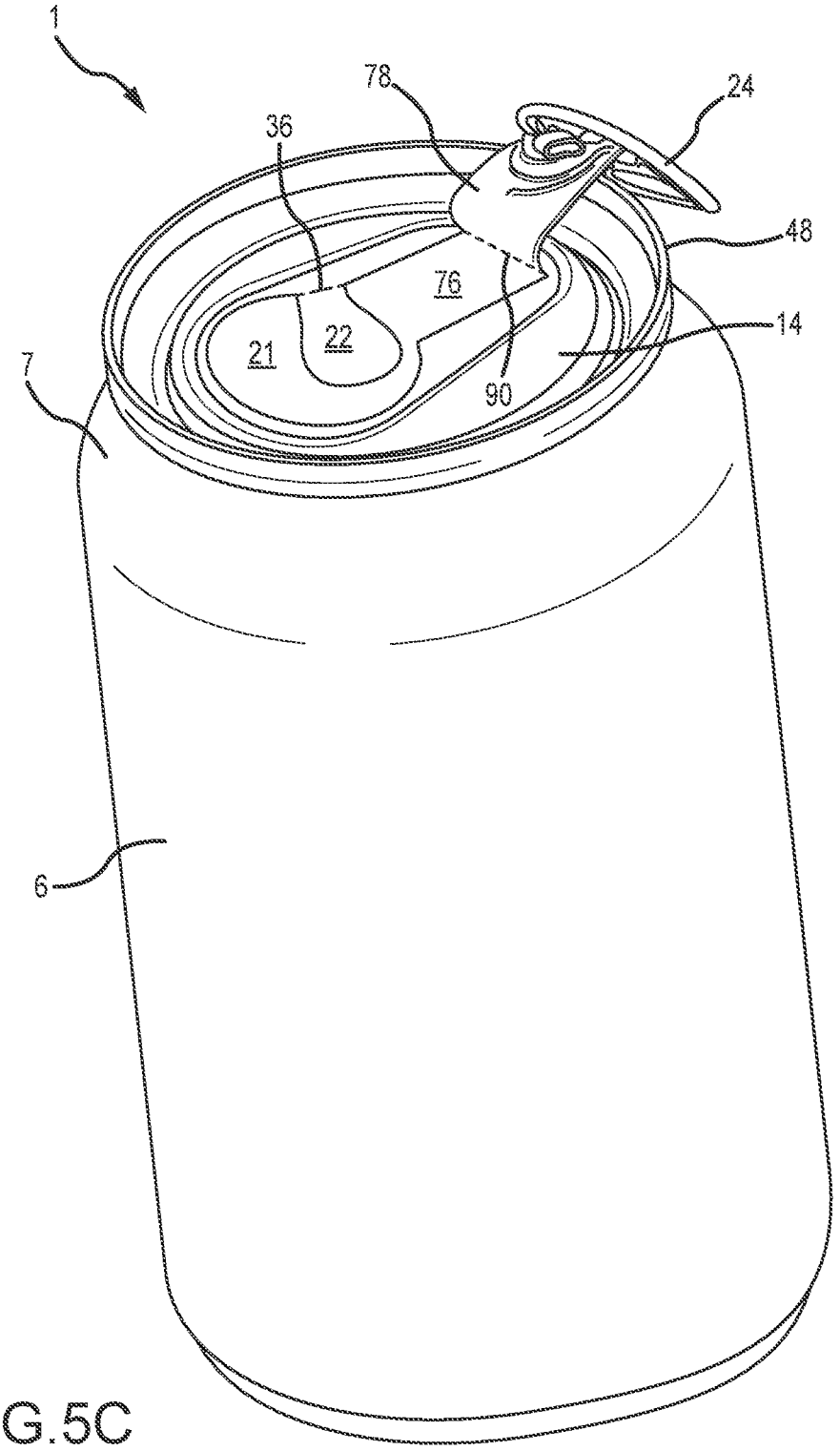
FIG. 5C is perspective view of the container end closure and container of FIG. 4 with the first tear panel and second tear panel in an open configuration.

Referring now to FIG. 5C, a perspective view of the container end closure 14 in an open configuration is provided and shown interconnected to a typical beverage container 1. As shown, the first tear panel 22 has been bent inwardly at the first hinge 36 into the container 1 to open the pour opening 21. The first tear panel 22 remains connected to the end closure 14 by the first hinge 36. After the pour opening 21 is opened, the tab 24 is pulled away from the pour opening 21 to sever the second and third scores to open the secondary vent opening 76. The second tear panel 78 is retained by the second hinge 90 and is bent over the peripheral seam 48. In one embodiment, the first tear panel 22 has an area or an openable area of approximately 0.500 inches. In another embodiment, the openable area of the first tear panel 22 may be approximately 0.700 inches. In one embodiment, an area or an openable area of the second tear panel 78 is equal to or greater than the area of the first tear panel 22 so that a rate or volume of air entering the container equals a second rate or volume of product leaving the container 1 when the product is poured from the container. In one embodiment, when completely opened by a consumer, the combined area of the pour opening 21 and the secondary vent opening 76 have an area of approximately one-third of a total surface area of the end closure 14. However, as will be appreciated by one of ordinary skill in the art, the first tear panel 22 and the second tear panel 78 may be varied in size. As will be recognized by one of ordinary skill in the art, area as used herein refers to the surface area of first and second tear panels 22, 78 and the pour opening 21 and the secondary vent opening 76 as defined by their respective score lines as shown and described herein.

Figure 6A:
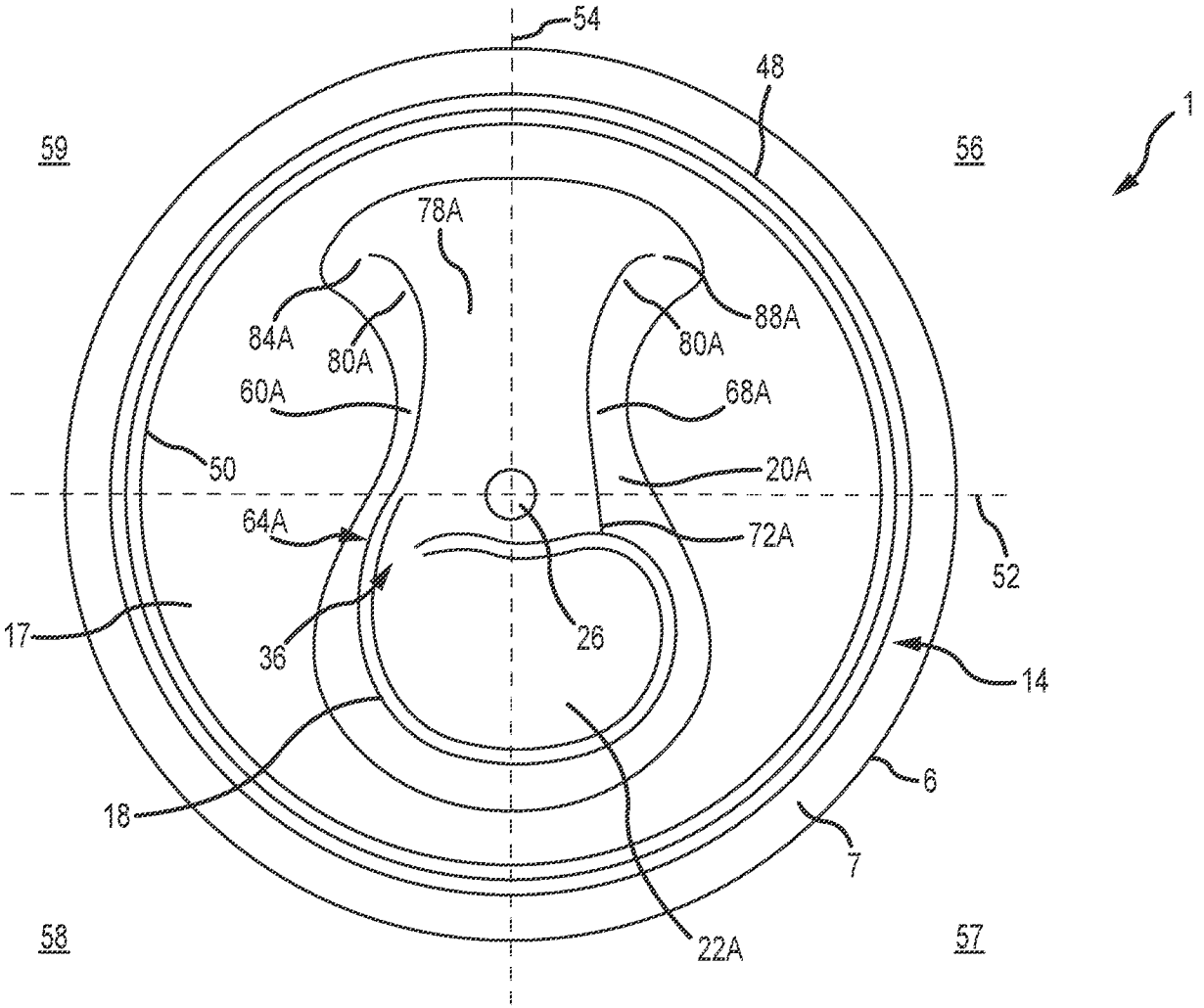
FIG. 6A is a top plan view of a container end closure interconnected to a neck of a container according to another embodiment of the present invention, wherein a first tear panel and a second tear panel are in a closed configuration.

Referring now to FIG. 6A, a top plan view of an embodiment of an end closure 14 with a modified second tear panel 78A is illustrated. The end closure 14 is interconnected to the neck 7 of a container 1. The first tear panel 22A is defined by the first score 18 and the first hinge 36 in the lower quadrants 57, 58. A second score line 68A begins proximate the first score line 18 at approximately a right angle near a right transition zone 72A. A third score 60A begins proximate the first score line 18 near a left transition zone 64A. The left transition zone 64A is positioned radially outside the first hinge 36 on the left side of the Y-axis 54. Stated otherwise, the left transition zone 64A is located between the hinge 36 and the outer perimeter 50 of the central panel 17. In one embodiment, the left transition zone 64A may be located further from the rivet 26 than the right transition zone 72A. The score lines 60A, 68A have a generally curvilinear shape and extend away from the first score line 18 across the end closure 14 into the upper quadrants 56, 59 to ends 84A, 88A. In one embodiment, the scores 60A, 68A have a minimum length of approximately 0.675 inches.

Score termination features 80A comprise curved segments near score ends 84A, 88A. The score termination features 80A flare radially outwardly to direct the path of the scores 60A, 68A toward the panel outer perimeter 50 to prevent the second tear panel 78A from detaching from the end closure 14. The score termination features 80A may generally comprise curved segments with a radius of curvature between approximately 0.060 inches and approximately 0.500 inches. In a preferred embodiment, the radius of curvature of the curved segment may be between approximately 0.217 inches and approximately 0.437 inches. In a more preferred embodiment, the radius of curvature of the curved segment may be approximately 0.375 inches. Although a second hinge 90 is not illustrated in FIG. 6A, a second hinge 90 may optionally be positioned approximately between score ends 84A, 88A. FIG. 6A also illustrates a modified debossed area 20A generally comprising a different, optional shape compared to the debossed area 20 of the embodiment illustrated in FIG. 4.

Figure 6B:
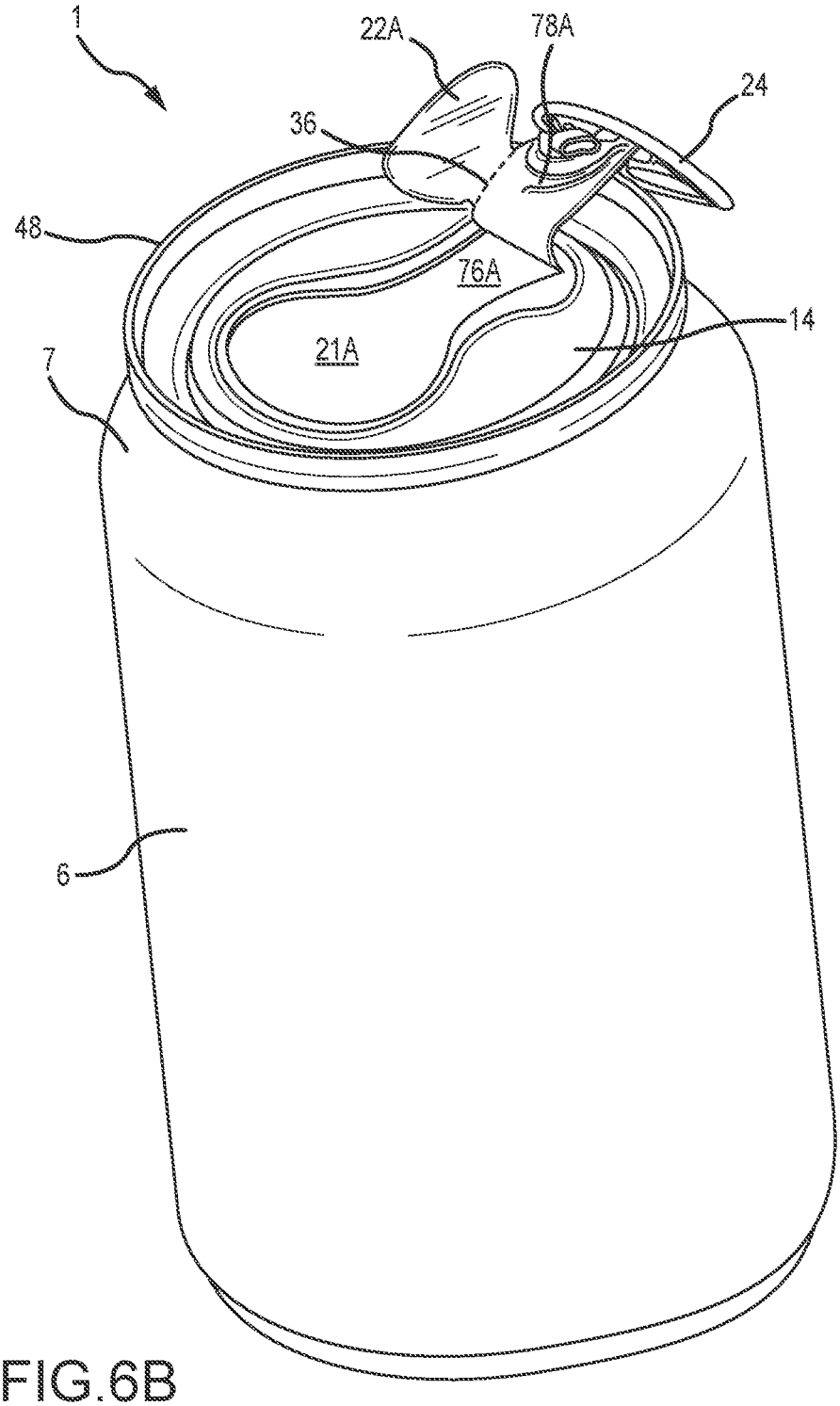
FIG. 6B is perspective view of the container end closure and container of FIG. 6A with the first tear panel and second tear panel in an open configuration.

Referring now to FIG. 6B, a perspective view of the container end closure 14 and container 1 of FIG. 6A are illustrated with the first tear panel 22A and second tear panel 78A in an open configuration. The first tear panel 22A is initially bent inwardly at the first hinge 36 into the container 1 to open the pour opening 21A. After the pour opening 21A is opened, the tab 24 is pulled away from the pour opening 21A to sever the second and third scores to open the secondary vent opening 76A. The first tear panel 22A is connected to the second tear panel 78A at the first hinge 36 and is pulled out of the container 1 when the secondary vent opening 76A is opened. The first and second tear panels 22A, 78A remain connected to the end closure 14 and are bent over the peripheral seam 48.

Figure 7:
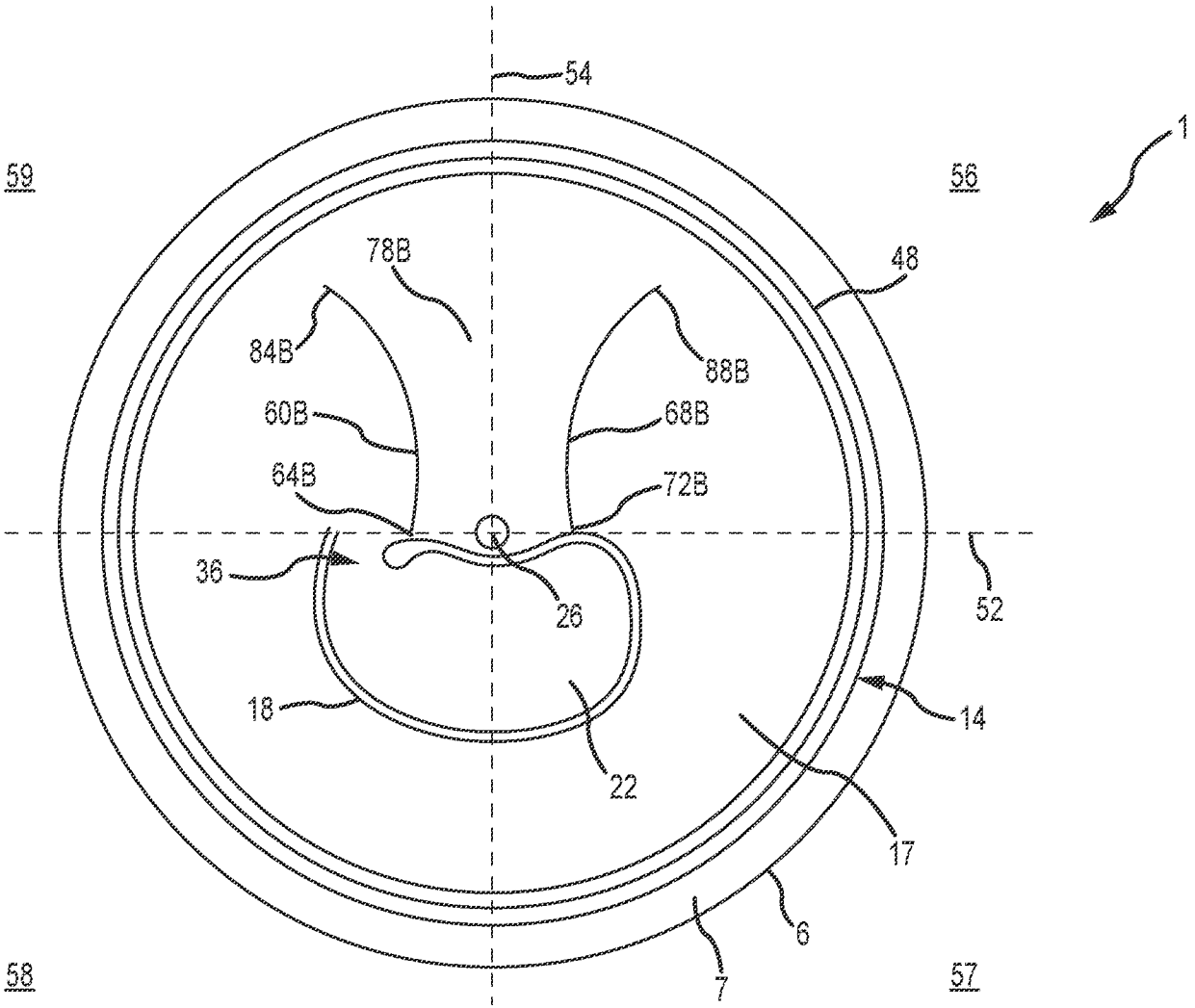
FIG. 7 is a top plan view of a container end closure interconnected to a neck of a container according to yet another embodiment of the present invention with a first tear panel and a second tear panel in a closed configuration.

FIG. 7 illustrates another embodiment of second tear panel 78B formed in an end closure 14. The end closure 14 is interconnected to a container 1 at a neck 7 of the body 6. A first tear panel 22 is formed in the lower quadrants 57, 58 by a first score 18 and a first hinge 36. As shown, a second score 68B begins on the right side of the Y-axis 54 near the right transition zone 72B. The second score 68B is substantially perpendicular to the first score 18. A third score 60B begins on the left side of the Y-axis 54 proximate the first score 18 near a left transition zone 64B. In the embodiment illustrated in FIG. 7, the left transition zone 64B is positioned radially inward of the first hinge 36 between the first hinge 36 and the rivet 26. Although not illustrated in FIG. 7, a second hinge 90 comprising a form 94 may optionally be positioned between scores 60B and 68B. In one embodiment, the second hinge 90 is positioned between score ends 84B, 88B and extends into the upper quadrants 56, 59. The second hinge 90 is generally perpendicular to the Y-axis 54. The second hinge 90 may have the dimensions described in conjunction with FIGS. 4 and 5B. Further, although no debossed area 20 is illustrated in FIG. 7, a debossed area 20 may be formed in the end closure 14 of any shape, such as a size and shape similar to the debossed area 20 illustrated in FIG. 4 or the debossed area 20A illustrated in FIG. 6A, or a combination of the shapes of debossed areas 20 and 20A. When the end closure 14 is opened, the first tear panel 22 is pressed into the container 1 and is retained within the container by the first hinge in a manner similar to the end closure illustrated in FIG. 5C. After the first tear panel 22 is pressed into the container 1, the tab may be pulled backwardly toward the upper quadrants 56, 59 to sever the second score 68B and the third score 60B. The second tear panel 78B and the tab are then bent over the peripheral seam 48 similar to the embodiment of the second tear panel 78 illustrated in FIG. 5C.

Figure 8:
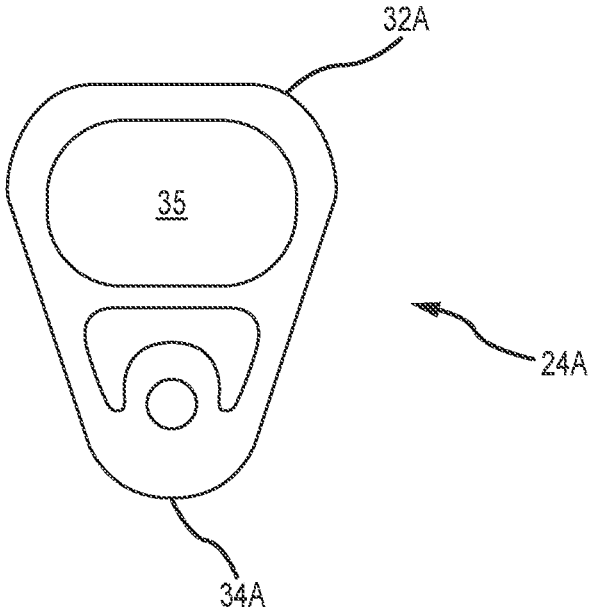
FIG. 8 is a top plan view of a pull tab according to one embodiment of the present invention.

FIG. 8 illustrates a stay-on ring pull tab 24A in one embodiment of the present invention. The ring pull tab 24A is generally larger than a conventional pull tab 24 as illustrated in FIG. 1. The increased size is provided in some embodiments to allow an improved gripping area for a user to grasp while opening the secondary vent opening. The tab 24A has a rear edge 32A, a forward edge 34A, and an optional open area 35 forming a loop. In one embodiment, the open area 35 of the tab 24A may be enclosed to form a grip area (not illustrated). A series of ridges, grooves, bumps, protrusions, or other friction surfaces selected to facilitate grasping and pulling of the tab 24A by the consumer are formed in the grip area. The material of the grip area may differ from the material of the tab 24A. For example, the grip area may include rubber, plastic, and/or any other materials selected improve friction between a consumer's finger and the tab 24A.

In operation, the method of opening an end closure of the present invention is similar to the method used to open known container ends with stay-on-tabs. Further, because the tab of the present invention is familiar to consumers there is little requirement to educate consumers on the method of opening the pour opening and secondary vent of the end closure of the present invention.

To open the pour opening and secondary vent opening, the rear edge 32 of the tab 24 is pulled upward by the consumer causing the forward edge 34 to apply a downward force to the first tear panel 22. The downward force of the forward edge 34 severs the first score 18 and opens the pour opening 21 as the tear panel 22 is pushed down, pivoting away from the consumer at the first hinge 36 into the container 1. At this point, the consumer can consume the beverage in the container 1 much like in a container with a prior art end closure by pushing the tab 24 back down into its initial position substantially parallel to the end closure 14. Alternatively, while the tab 24 is still pulled up at an angle compared to the end closure 14, the consumer can pull the tab 24 back away from the pour opening 21, toward the upper quadrants 56, 59 tearing score lines 60, 68. As the score lines 60, 68 are torn by the pulling force, the second tear panel 78 is pulled up and back to open the secondary vent opening 76. The tab 24 and the second tear panel 78 can then be folded back over an edge formed by the peripheral seam 48 away from the consumer. In the embodiments illustrated in FIGS. 4 and 7, the first tear panel 22 remains attached to the end closure 14 and is pressed into the interior of the container under the central panel 17 separate from the second tear panel 78 as illustrated in FIG. 5C. In the embodiment illustrated in FIG. 6A, the first tear panel 22A is connected to second tear panel 78A by the first hinge 36. When the tab 24 is pulled back to sever scores 60A, 68A, the first tear panel 22 is pulled up and out of the pour opening 21 with the second tear panel 78A when the secondary vent opening 76A is opened as shown in FIG. 6B. Alternatively, the consumer can select to open the secondary vent only a partial amount rather than the full amount, based on personal preference.

In practice, a container end closure of the present invention may be formed by providing a generally flat blank according to procedures well known in the art. A die may be used to stamp the container end closure providing scores configured as depicted in the Figures and, preferably, other features such as reinforcing beads or other reinforcements and the like. A tab is interconnected to the container end closure generally as provided in previous procedures well known to those of skill in the art. The container end closure thus formed may be coupled to a container body, formed according to procedures known to those of skill in the art, to provide a complete container.

Producing container end closures in the manner and form of the present invention can be achieved using materials and apparatus generally similar to that used in previous procedures for forming container end closures such as those depicted in FIGS. 1 and 2. A die or other scoring device can be configured to provide the first score 18 and scores 60, 68 and, optionally, the second hinge 90 as depicted in FIGS. 1-7. Optionally, reinforcing or other features may be formed on the end closure. In this way, it is possible to implement the present invention with few changes to previous procedures and apparatus thus minimizing or reducing costs associated with retooling, procedural changes, testing and the like. Of course, if desired, it is possible to use the present invention in connection with different container or container end closure designs, shapes, or sizes.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A method of forming a metallic end closure with a pour opening and a secondary vent, comprising:

cutting a metal blank from a sheet metal material;

forming an end closure from said metal blank, said end closure comprising a chuck wall extending downwardly from a peripheral curl, a countersink interconnected to a lower end of said chuck wall, and a central panel interconnected to said countersink;

forming a first severable score in said central panel, said first severable score having an origination point and a termination point, wherein said first severable score defines a first tear panel and a first hinge to define said pour opening;

forming a second severable score in said central panel, said second severable score originating proximate to said first severable score on a first side of a vertical axis passing through a center of said central panel, said second severable score extending away from said first score to a second termination point;

forming a third severable score in said central panel, said third severable score originating proximate to said first score and said first hinge, said third severable score positioned on a second side of said vertical axis, said third severable score extending away from said first hinge to a third termination point, wherein said third termination point is spaced from said second termination point;

forming a second hinge defined at least partially by a channel in said central panel, said second hinge positioned between said second severable score and said third severable score; and interconnecting an opening tab having a nose with a forward edge and a tail end to said central panel, wherein said opening tab is substantially centered on said central panel, wherein said first tear panel is positioned below at least a portion of said nose forward edge, and wherein said second hinge and said second and third severable scores define a second tear panel and said secondary vent, and wherein said second and third severable scores are severed by pulling said opening tab upwardly above said central panel.

2. The method of claim 1, wherein said channel of said second hinge is at least one of:

spaced from said center of said central panel by between approximately 0.500 inches and approximately 0.850 inches;

between approximately 0.001 inches and approximately 0.030 inches deep; and between approximately 0.100 inches and approximately 1.00 inches in length.

3. The method of claim 1, wherein said second hinge is positioned proximate to said second and third termination points of said second and third severable scores.

4. The method of claim 1, wherein said second hinge extends approximately perpendicular to said vertical axis.

5. The method of claim 1, further comprising forming a second score termination feature and a third score termination feature, wherein said second score termination feature and said third score termination feature are adapted to prevent said second tear panel from detaching from said central panel, and wherein said third severable score line is substantially symmetric to said second severable score line.

6. The method of claim 1, wherein said first severable score has a first depth, said second severable score has a second depth and said third severable score has a third depth, and wherein said second and third depths are greater than the first depth of said first severable score.

7. The method of claim 1, wherein said third severable score has an origination point positioned between said center of said end closure and a radially inner portion of said first hinge.

8. The method of claim 1, further comprising forming transition portions between said first severable score and said second and third severable scores, wherein said transition portions are adapted to prevent a premature fracture propagation of said first severable score into said second and third severable scores.

9. The method of claim 8, wherein said transition portions comprise at least one of:

a score deviation in said second and third severable scores;

a void area between said first severable score and said second and third severable scores;

a variation in residual depth of said first severable score and said second and third severable scores; and a score path of said second and third severable scores oriented tangentially to a direction of fracture of the first severable score.

10. A method of manufacturing an end closure adapted to be interconnected to a neck of a container, comprising:

providing a blank cut from a metallic material; and forming the blank into an end closure, comprising:

a peripheral curl adapted for interconnection to the neck of the container;

a chuck wall interconnected to the peripheral curl;

a countersink interconnected to the chuck wall;

a central panel interconnected to the countersink;

a first score which is selectively severable and which defines a tear panel and a first hinge;

a second score which is selectively severable and which extends away from the first score, the second score being on a first side of an axis passing through the tear panel and a center of the central panel;

a third score which is selectively severable and which extends away from the first score, the third score being on a second side of the axis;

a second hinge positioned at least partially between the second and third scores and having a length that is approximately perpendicular to the axis, the second hinge and the second and third scores defining a vent panel; and a tab interconnected to the central panel.

11. The method of claim 10, wherein the second and third scores include termination features to prevent detachment of the vent panel from the central panel, the termination features defined by a change in a direction of the second and third scores.

12. The method of claim 10, wherein the end closure further comprises:

a first transition zone positioned between the first score and the second score; and a second transition zone positioned between the first score and the third score, the transition zones positioned to prevent premature fracture propagation of the first score into the second and third scores.

13. The method of claim 12, wherein the first and second transitions zones comprise at least one of:

a void area positioned between the first score and the respective second and third scores;

a score deviation in the second and third scores;

a variation in residual depth of the first score compared to the second and third scores; and a score path of the second and third scores that is tangent to a direction of fracture of the first score.

14. The method of claim 10, wherein:

the second score has a second termination point positioned proximate to the second hinge; and the third score has a third termination point positioned proximate to the second hinge, wherein the second termination point is spaced apart from the third termination point.

15. A method of manufacturing a metallic end closure with a secondary vent, comprising:

cutting a blank from a sheet of metallic material;

forming an end closure from the blank which includes:

a peripheral curl adapted for interconnection to a neck of a container;

a chuck wall interconnected to the peripheral curl;

a countersink interconnected to the chuck wall; and a central panel interconnected to the countersink;

forming a first score in the central panel, the first score being selectively severable and defining a pour opening and a first hinge;

forming a second score in the central panel which has a second score termination point positioned on a first side of an axis passing through the pour opening and a center of the central panel, the second score being selectively severable and extending away from the first score, wherein a first transition zone is positioned between the first score and the second score to prevent unintended fracture propagation of the first score into the second score;

forming a third score in the central panel proximate to the first hinge which has a third score termination point positioned on a second side of the axis, the third score being selectively severable and extending away from the first score, wherein a second transition zone is positioned between the first score and the third score to prevent unintended fracture propagation of the first score into the third score, and wherein the second and third scores define the secondary vent; and interconnecting a pull tab to the central panel, said pull tab including a nose and a tail end.

16. The method of claim 15, further comprising forming a second hinge between the second and third scores, the second hinge comprising an alteration of an exterior surface of the central panel, and wherein the second hinge is oriented approximately perpendicular to the axis.

17. The method of claim 15, wherein the second score termination point is spaced from the third score termination point by a predetermined distance, and wherein the second score includes a termination feature to prevent detachment of the second tear panel from the central panel.

18. The method of claim 17, wherein the termination feature comprises a curved segment of the second score proximate to the countersink.

19. The method of claim 15, wherein the first score is formed with a first depth, the second score is formed with a second depth, and the third score is formed with a third depth, and wherein the first depth is different than the second and third depths.

20. The method of claim 15, wherein the third score is oriented substantially symmetric to the second score with respect to the axis positioned there-between.

* * * * *